US009758349B2

(12) United States Patent
Mandy et al.

(10) Patent No.: US 9,758,349 B2
(45) Date of Patent: Sep. 12, 2017

(54) ELEVATOR VENTILATION FAN ASSEMBLY

(71) Applicant: Man-D-Tec, Inc., Scottsdale, AZ (US)

(72) Inventors: Dalton J. Mandy, Scottsdale, AZ (US); Terry R. Mandy, Paradise Valley, AZ (US); Brandon R. Mandy, Scottsdale, AZ (US); Tyler Flake, Mesa, AZ (US)

(73) Assignee: Man-D-Tec, Inc., Scottsdale, AZ (US)

( * ) Notice: Subject to any disclaimer, the term of this patent is extended or adjusted under 35 U.S.C. 154(b) by 838 days.

(21) Appl. No.: 13/963,450

(22) Filed: Aug. 9, 2013

(65) Prior Publication Data

US 2015/0044957 A1 Feb. 12, 2015

(51) Int. Cl.
*F04B 35/04* (2006.01)
*B66B 11/02* (2006.01)

(52) U.S. Cl.
CPC ..... *B66B 11/024* (2013.01)

(58) Field of Classification Search
CPC ... B66B 11/024; F04D 19/522; F04D 19/526; F04D 19/601; F04D 19/646; F04D 19/701; F04D 9/522; F04D 9/526; F04D 9/601; F04D 9/646; F04D 9/70122
USPC ..... 417/360, 363, 423.15
See application file for complete search history.

(56) References Cited

U.S. PATENT DOCUMENTS 2,331,958 A * 10/1943 Breese ..... F04D 29/626 248/27.1
2,398,627 A * 4/1946 Disbro ..... B66B 11/024 422/121
2,784,661 A * 3/1957 Jenn ..... F24F 7/013 415/142
3,206,148 A * 9/1965 Longsworth ..... F04D 29/646 248/621
3,472,150 A * 10/1969 Strawsine ..... B60H 1/00464 137/854
3,773,285 A * 11/1973 Morrill ..... F16F 15/08 244/230
3,826,183 A * 7/1974 Rudine ..... F04D 25/14 137/533.27
3,926,537 A * 12/1975 Piper ..... F04D 29/626 417/353
3,934,494 A * 1/1976 Butler ..... F24F 11/0001 454/342
4,036,292 A * 7/1977 Hine, Jr. ..... F04D 29/626 165/122
4,048,911 A * 9/1977 Petersen ..... B60H 3/0616 454/136
4,085,726 A * 4/1978 Van Boven ..... F24H 9/0073 126/110 R (Continued)

*Primary Examiner* — Charles Freay
(74) *Attorney, Agent, or Firm* — Reising Ethington P.C.

(57) ABSTRACT

An elevator ventilation fan assembly for hazardous operating environments and comprising a fan disposed within an enclosure to be carried on an elevator cab roof. The fan may be suspended by a fan support framework from at least three non-co-linear suspension locations of the enclosure lid. The assembly may include a vibration isolation element disposed between the fan motor and the enclosure lid, a cover panel supported by a cover support framework on the enclosure lid, a fan guard screen carried by the enclosure lid, a fan motor junction box carried within the enclosure by the lid and accessible via a removable side panel of the enclosure, and/or a fan duct surrounding the fan.

20 Claims, 3 Drawing Sheets

(56) References Cited

U.S. PATENT DOCUMENTS

| | | | | | |
|---|---|---|---|---|---|
| 4,501,194 | A * | 2/1985 | Brown | F24F 7/025 | 454/354 |
| 4,633,769 | A * | 1/1987 | Milks | F24F 7/025 | 454/117 |
| 5,492,456 | A * | 2/1996 | Knight | F04D 29/668 | 248/604 |
| 7,677,964 | B1 * | 3/2010 | Bucher | F24F 7/025 | 454/356 |
| 7,731,574 | B2 * | 6/2010 | Milks | B60J 7/1642 | 296/216.02 |

* cited by examiner

ELEVATOR VENTILATION FAN ASSEMBLY

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND

Field

This application relates generally to an elevator ventilation fan assembly for operation in hazardous environments.

Description of Related Art Including Information Disclosed Under 37 CFR 1.97 and 1.98

Elevator ventilation fan assemblies, such as those carried on the roofs of construction elevators, are known to include features that protect ventilation fans from weather, dust, debris, and other threats known to create hazardous operating environments.

SUMMARY

An elevator ventilation fan assembly for hazardous operating environments is provided. The assembly comprises a fan disposed within an enclosure configured to be carried on an elevator cab roof. The fan may comprise fan blades carried by a shaft rotatably supported and drivable by an electric fan motor. The fan motor may be carried by and suspended from a removable lid of the enclosure. The elevator ventilation fan protection assembly may also comprise a rigid fan support framework that suspends the fan motor from at least three non-co-linear suspension locations of the enclosure lid, a vibration isolation element disposed between the fan motor and the enclosure lid and configured to absorb motor-damaging vibrations, a cover panel carried by and spaced above the enclosure lid by a cover support framework, and/or a fan guard screen carried by the enclosure lid and spanning an exhaust air hole formed in the enclosure lid above the fan. The fan guard screen may be configured to protect the fan blades and motor from foreign objects while minimizing airflow impedance. Alternatively or additionally, a fan motor junction box may be carried within the enclosure by the lid and may be accessible via a removable side panel of the enclosure, and/or a fan duct may surround the fan.

DRAWING DESCRIPTIONS

These and other features and advantages will become apparent to those skilled in the art in connection with the following detailed description and drawings of one or more embodiments of the invention, in which.

DETAILED DESCRIPTION

Figure 1:
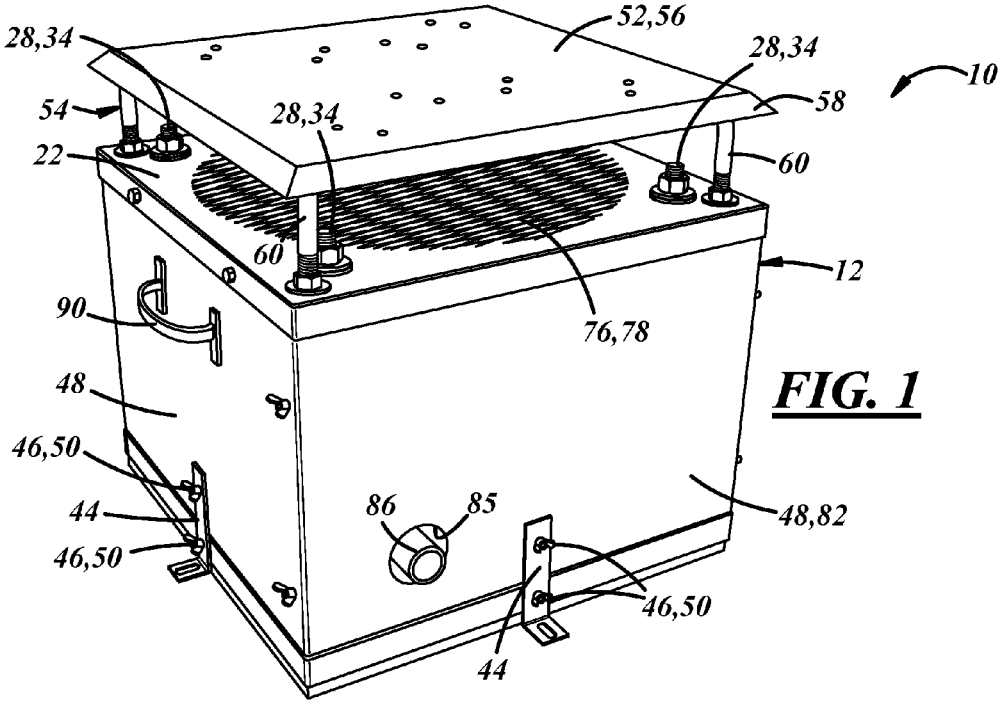
FIG. 1 is a perspective view of an elevator ventilation fan assembly.
Figure 2:
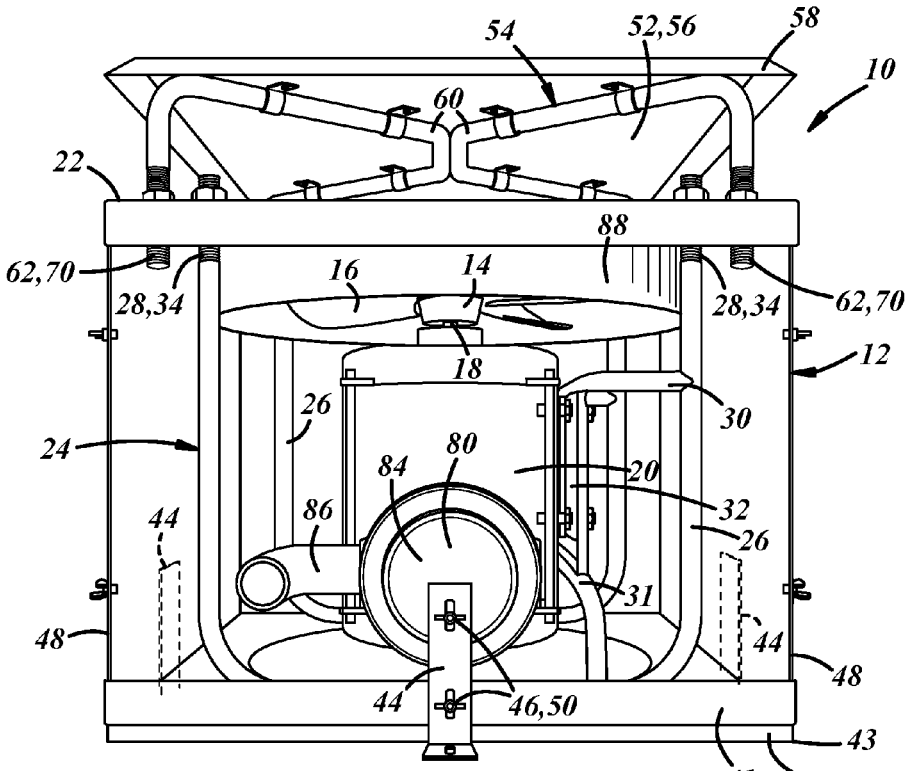
FIG. 2 is a perspective cutaway view of the assembly of FIG. 1.
Figure 3:
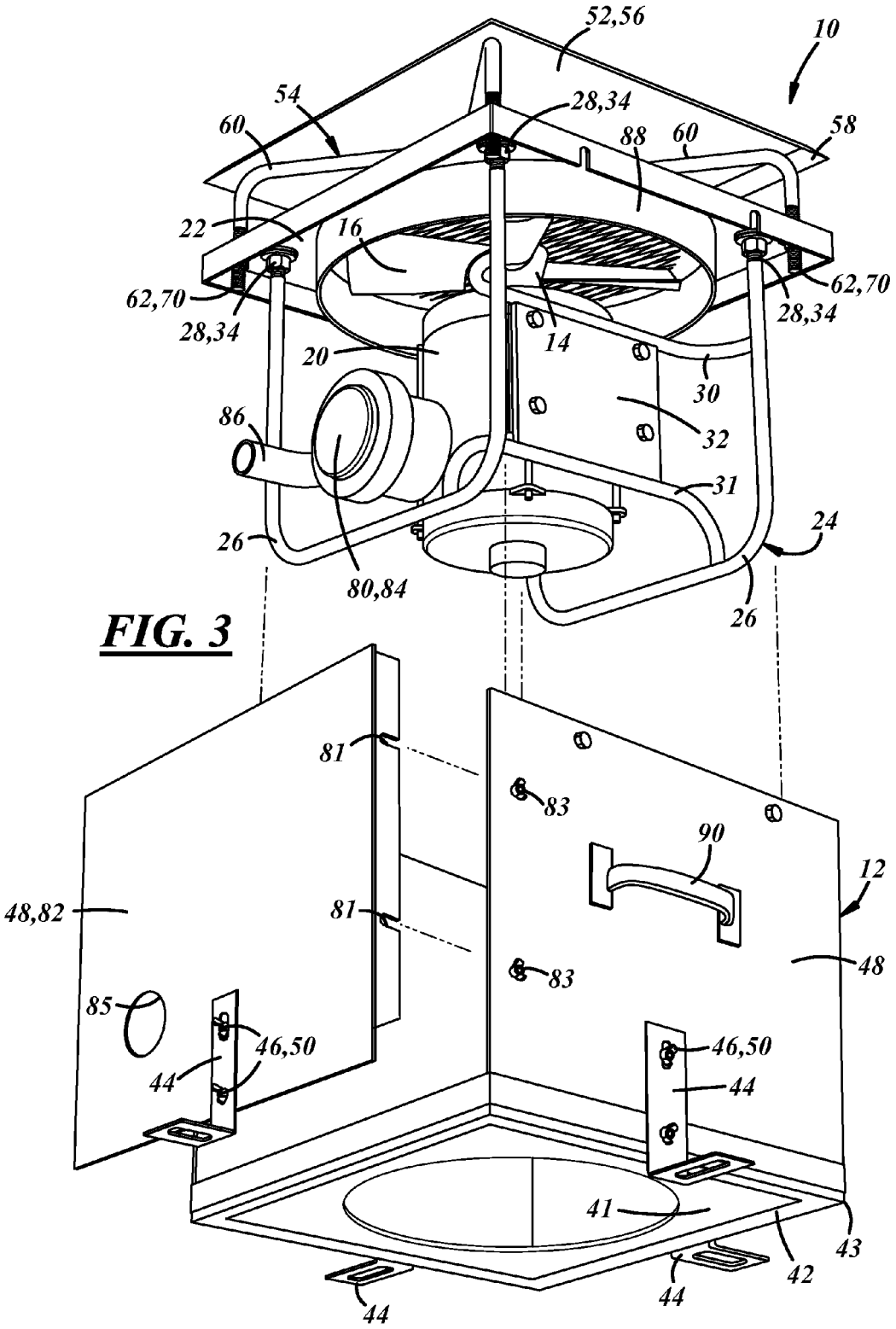
FIG. 3 is an exploded view of the assembly.

An elevator ventilation fan assembly configured to survive a hazardous operating environment is generally shown at 10 in FIGS. 1-5. The assembly 10 may include a metal enclosure 12 configured to be carried on an elevator cab roof 13, and a fan 14 disposed within the enclosure 12. As shown in FIGS. 2 and 3, the fan 14 may comprise spark resistant cast aluminum fan blades 16 carried by a shaft 18 rotatably supported and drivable by an electric HAZLOC fan motor 20 (i.e., a motor rated for hazardous duty). The fan motor 20 may be carried by and suspended from a removable lid 22 of the enclosure 12.

As shown in FIGS. 2 and 3, the assembly 10 may also include a rigid fan support framework 24 suspending the fan motor 20 from at least three, and preferably four non-co-linear suspension locations of the enclosure lid 22. The support framework 24 may thus suspend the fan motor 20 more securely from the lid 22 by eliminating sway and the danger of consequent support material failure. The fan support framework 24 may comprise two ½" aluminum suspension rods 26 connected at respective upper ends 28 to the enclosure lid 22 and carrying the fan motor 20 between them. Two laterally extending rods 30, 31 may interconnect the suspension rods 26 and carry a mounting plate 32 that carries the fan motor 20.

Figure 4:
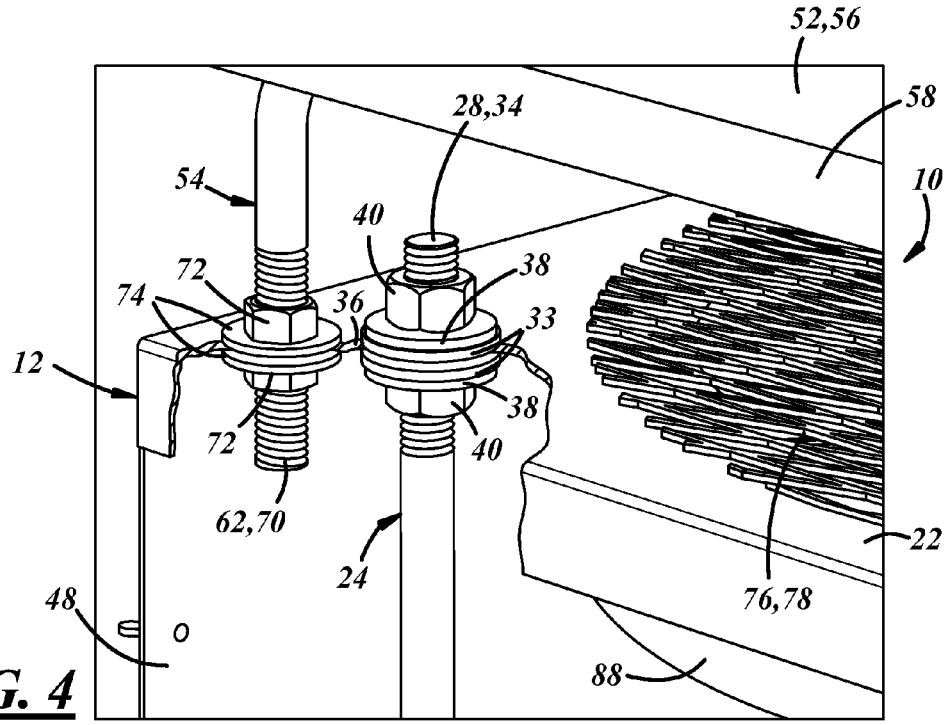
FIG. 4 is a magnified view of a lid and attachment points for structural frames of the assembly.

As shown in FIG. 4, an upper vibration isolation element 33 may be disposed between the fan motor 20 and the enclosure lid 22. The upper vibration isolation element 33 may be configured to absorb motor-damaging vibrations induced by, for example, contaminants causing an out-of-balance condition on the fan 14 by falling on and adhering to one or more of the fan blades 16.

As best shown in FIG. 4, threaded portions 34 of the suspension rod upper ends 28 may extend through holes 36 formed in respective corner regions of the enclosure lid 22, and the upper vibration isolation element 33 may comprise two rubber washers received on each of the upper ends 28 of the two suspension rods 26, disposed on upper and lower sides of the enclosure lid 22 and sandwiched between metal washers 38 that are, in turn sandwiched between upper and lower fastener nuts 40. The fastener nuts 40 may be carried and threadedly engaged by the threaded portions 34 of each of the suspension rod upper ends 28.

A lower vibration isolation element 42 may be disposed on a lower surface 41 of the enclosure 12 where the element 42 may be sandwiched between the enclosure 12 and an elevator cab roof 13 carrying the enclosure 12, as shown in FIG. 2, to further protect the motor 20 from vibration damage and to insulate the elevator cab from noise and vibration. The lower vibration isolation element 42 may comprise a dense rubber foam gasket extending around a lower perimeter edge 43 of the enclosure 12.

Figure 5:
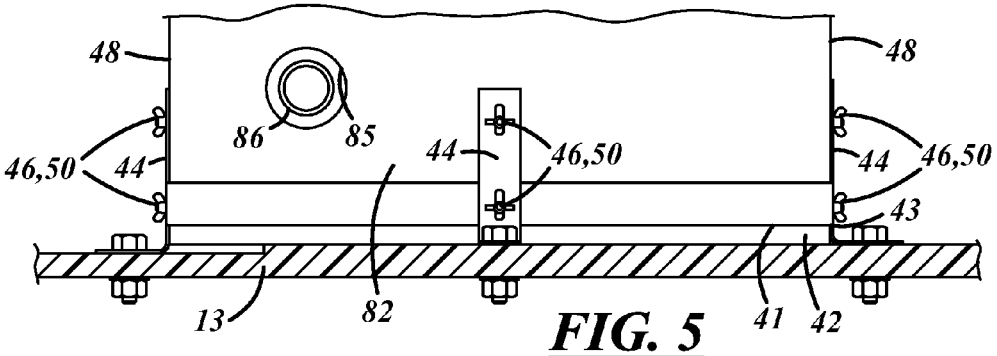
FIG. 5 is a fragmentary partial cross-sectional side view of a base of the assembly and a portion of an elevator roof carrying the assembly.

As best shown in FIGS. 2 and 5, the lower vibration isolation element may include four slotted brackets 44 configured to receive threaded shafts 46 extending from side walls 48 of the enclosure 12 and from an elevator cab roof 13. The brackets 44 may be further configured to secure the enclosure 12 to an elevator cab roof 13 via wing nuts 50 threadedly engaged on the threaded shafts 46 and tightened down against the brackets 44. The brackets 44 may be supported for vertical sliding adjustment on the side walls 48 of the enclosure 12 when the wing nuts 50 are loosened, to allow the enclosure 12 to settle into a position generally flush with the elevator cab roof 13 and sealed against the elevator cab roof 13 by the lower vibration isolation gasket 42.

Figure 6:
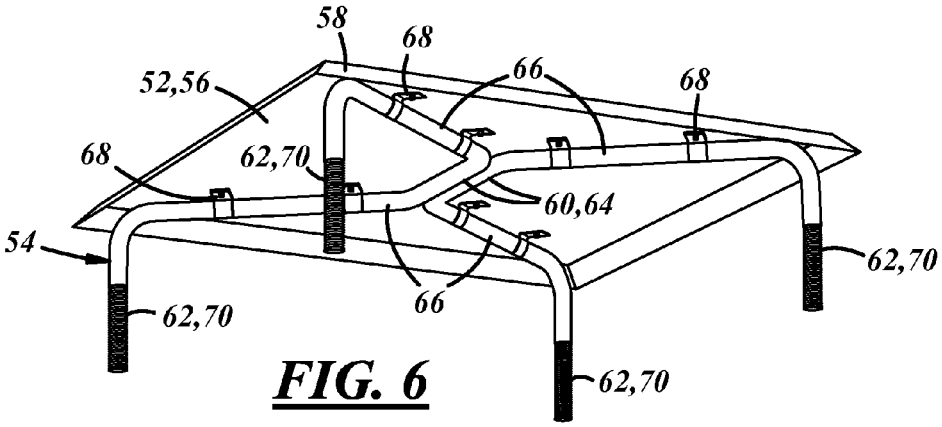
FIG. 6 is a perspective view of the assembly lid.

As best shown in FIGS. 2 and 6, a cover panel 52 may be carried by and spaced above the enclosure lid 22 by a cover panel support framework 54 to prevent projectiles and contaminant substances from dropping on and contaminating or causing impact damage to the fan blades 16 and motor 20. The cover panel 52 may be generally co-extensive with the enclosure lid 22 and may comprise a flat center section 56 and a perimeter edge 58 angled approximately 45 degrees downward relative to the center section 56 to provide edge stiffness to the cover panel 52 while allowing exhaust air to escape more easily than if the perimeter edge 58 were angled normal to the center section 56. The cover support framework 54 may also allow elevator repair personnel to stand on the cover 52 without collapsing the cover 52 and damaging the fan 14. The cover panel support framework 54 may comprise two ½" aluminum support rods 60 carrying the cover panel 52 and connected at respective cover panel support rod lower ends 62 to the enclosure lid 22. The cover panel support rods 60 may be configured to cooperate in supporting loads carried by the cover panel 52. The cover panel 52 and cover panel support framework 54 may be configured to support a 300 pound weight to support the weight of an elevator maintenance worker.

As best shown in FIG. 6, each cover panel support rod 60 may comprise a center portion 64 and two mid portions 66 extending integrally from opposite ends of the center portion 64 and angled relative to the center portion 64 in a common generally horizontal plane. The lower ends 62 of each rod 60 may extend integrally from outer ends of the mid portions 66. The lower ends 62 may be angled downward generally normal to the common generally horizontal plane. The center portions 64 of each rod 60 may be disposed centrally under the cover panel 52, parallel and adjacent one another, and in plane with the mid portions 66 of each rod. The mid portions 66 of the cover panel support rods 60 may be fastened to the cover panel 52 by pipe straps 68 riveted to the cover panel 52.

As shown in FIG. 4, threaded portions 70 of the cover panel support rod lower ends 62 may extend through holes 64 formed in respective corner regions of the enclosure lid 22. Each rod 60 may be fastened to the enclosure lid 22 by upper and lower cover panel nuts 72 carried and threadedly engaged by the threaded portions 70 of each of the cover panel support rod lower ends 62. The upper and lower cover panel nuts 72 may be disposed above and below the enclosure lid 22, respectively, and may compress the enclosure lid 22 between them. Upper and lower washers 74 may be carried by each of the rod lower ends 62. The upper and lower washers 74 may be disposed above and below the enclosure lid 22, respectively, and may be sandwiched between the upper and lower cover panel nuts 72.

As best shown in FIG. 4, a fan guard screen 76 may be carried by the enclosure lid 22. The fan guard screen 76 may span a circular exhaust air hole 78 formed in the enclosure lid 22 coaxially above the fan 14. The fan guard screen 76 may be configured to protect the fan blades 16 and motor 20 from foreign objects while minimizing airflow impedance. In a preferred embodiment, the fan guard screen 76 may be powder coated diamond-pattern expanded metal having openings of less than ⅜ inch at their widest points, but may have openings of any size, and may comprise any suitable material in other embodiments. The fan guard screen 76 may be formed with the enclosure lid 22 as a single unitary piece.

As best shown in FIG. 3, a fan motor junction box 80 may be carried within the enclosure 12 by the fan motor 20 to protect the fan motor junction box 80 from contaminants and elevator repair workers from an elevator rooftop tripping hazard. The fan motor junction box 80 may be accessible via a removable side panel 82 that may be carried by the enclosure 12 on a side of the enclosure 12 adjacent the fan motor junction box 80. The side panel 82 may comprise slots 81 positioned to receive threaded posts 83 extending from adjacent sides of the enclosure 12 such that loosening of wing nuts threadedly engaged on the threaded posts may allow the side panel 82 to be removed. Removing the side panel 82 may provide access to the fan motor junction box 80 for maintenance and/or to make wiring connections during installation, without having to unfasten the enclosure lid 22 and remove the fan motor junction box 80 from the enclosure 12 along with the fan 14 and cover panel 52.

As shown in FIGS. 2 and 3, the fan motor junction box 80 may comprise a cast aluminum housing 82 carried by the fan motor 20, which may be carried by the enclosure lid 22 so that the fan motor junction box 80 can be removed with the fan 14 by lifting the enclosure lid 22 from the enclosure 12. The fan motor junction box 80 may comprise a housing cover 84 removable via three axially-oriented screws (not shown) to allow for the interconnection of electrical motor wiring with wiring extending from a source of electrical power (not shown). The fan motor junction box 80 may comprise a steel elbow conduit 86 configured to route and protect the electrical power source wiring extending into the enclosure 12 and junction box housing 82 through a wiring hole 85 in the enclosure 12.

A fan duct 88 may surround the fan 14. The fan duct 88 may increase airflow and/or prolong fan 14 life by decreasing the amount of work the fan motor 20 must do to provide a given volumetric flow rate of air. The fan duct 88 may be carried by the enclosure lid 22 and may extend around and be generally co-extensive with the exhaust air hole 78. The fan duct 88 may be attached to the lid 22 by brackets (not shown) riveted to the duct 88 and to the enclosure lid 22.

As shown in FIGS. 1 and 3, handles 90 may be fastened to, and may extend from, either side of the enclosure 12. The handles 90 may be laterally centered relative to the center of gravity of the assembly 10 to allow for level carry, and may be vertically disposed just above the assembly center of gravity to facilitate manual transport of the assembly 10. Enabling level carry helps an installer to maintain balance while transporting the unit for installation on an elevator cab roof, which may require maneuvering over or around a structural cross beam, power supplies, suspension cables, conduits, and other obstructions on the cab roof and within the confines of an elevator shaft.

An elevator ventilation fan assembly constructed as described above prevents damage to elevator fans placed in hazardous environments. Such an assembly also allows for easy access to the fan for maintenance.

This description, rather than describing limitations of an invention, only illustrates an embodiment of the invention recited in the claims. The language of this description is therefore exclusively descriptive and is non-limiting. Obviously, it's possible to modify this invention from what the description teaches. Within the scope of the claims, one may practice the invention other than as described above.

What is claimed is:

1. An elevator ventilation fan assembly comprising:

an enclosure comprising a side wall and a lid removably carried by the side wall;

a fan disposed within the enclosure and comprising fan blades carried by a shaft rotatably supported and drivable by an electric fan motor, the fan motor being carried by and suspended from the lid, the fan being disposed between the lid and the fan motor;

a cover support framework carried by the enclosure;

a cover panel carried by the cover support framework in a position covering the fan and spaced above the enclosure lid and fan, an outer perimeter edge of the cover panel being spaced above the enclosure lid; and one or more fan protection components selected from the group of components consisting of:

a rigid fan support framework suspending the fan motor in a position spaced below the enclosure lid, from at least three non-co-linear suspension locations of the enclosure lid, a first vibration isolation element disposed between the fan motor and the enclosure lid and configured to absorb motor-damaging vibrations, a fan guard screen carried by the enclosure lid and spanning an exhaust air hole formed in the enclosure lid above the fan, the fan guard screen being shaped and positioned to protect the fan blades and motor from foreign objects and to protect maintenance personnel's fingers from injury, or a removable side panel carried by the side wall in a position covering a side access opening in the side wall, and a fan motor junction box carried within the enclosure by the lid and accessible via the side access opening upon removal of the removable side panel.

2. An elevator ventilation fan assembly as defined in claim 1 in which:

the one or more fan protection components includes at least the rigid fan support framework suspending the fan motor in a position spaced below the enclosure lid, from at least three non-co-linear suspension locations of the enclosure lid; and the fan support framework suspends the fan motor from a fourth suspension location of the enclosure lid.

3. An elevator ventilation fan assembly as defined in claim 2 in which the fan support framework comprises metal rods.

4. An elevator ventilation fan assembly as defined in claim 3 in which the fan support framework comprises two suspension rods connected at respective upper ends to the enclosure lid and carrying the fan motor between them.

5. An elevator ventilation fan assembly as defined in claim 4 in which the fan support framework comprises two laterally extending rods interconnecting the suspension rods and carrying the fan motor.

6. An elevator ventilation fan assembly as defined in claim 4 in which:

the suspension rod upper ends extend through holes formed in the enclosure lid;

the assembly includes a first vibration isolation element disposed between the fan motor and the enclosure lid; and the first vibration isolation element includes two rubber washers received on each of the upper ends of the two suspension rods, disposed on upper and lower sides of the enclosure lid and sandwiched between upper and lower fasteners carried by each of the upper ends.

7. An elevator ventilation fan assembly as defined in claim 1 and further including:

a first vibration isolation element disposed between the fan motor and the enclosure lid; and a second vibration isolation element disposed on a lower surface of the enclosure where the second vibration element will be sandwiched between the enclosure and an elevator cab roof carrying the enclosure.

8. An elevator ventilation fan assembly as defined in claim 7 in which the second vibration isolation element includes a gasket extending around a lower perimeter edge of the enclosure.

9. An elevator ventilation fan assembly as defined in claim 8 in which the second vibration isolation element includes a plurality of brackets configured to secure the enclosure to an elevator cab roof and supported for vertical sliding adjustment on the side wall.

10. An elevator ventilation fan assembly as defined in claim 1 in which the cover panel support framework comprises metal rods.

11. An elevator ventilation fan assembly as defined in claim 10 in which the cover panel support framework comprises two cover panel support rods carrying the cover panel and connected at respective cover panel support rod ends to the enclosure lid, the cover panel support rods being configured to cooperate in supporting loads carried by the cover panel.

12. An elevator ventilation fan assembly as defined in claim 11 in which each cover panel support rod comprises a center portion, two mid portions extending integrally from opposite ends of the center portion and angled relative to the center portion in a common generally horizontal plane, respective ends of the cover panel support rods extending integrally from outer ends of the mid portions and angled downward generally normal to the common generally horizontal plane, the center portions of each rod being disposed centrally under the cover panel, parallel and adjacent one another, and in plane with the mid portions of each rod.

13. An elevator ventilation fan assembly as defined in claim 12 in which:

the cover panel support rod ends extend through holes formed in the enclosure lid; and each cover panel support rod is fastened to the enclosure lid by upper and lower cover panel fasteners carried by each of the cover panel support rods and disposed above and below the enclosure lid, respectively, the enclosure lid being compressed between them.

14. An elevator ventilation fan assembly as defined in claim 1 in which the cover panel is generally co-extensive with the enclosure lid and comprises a flat center section and a perimeter edge angled downward relative to the center section.

15. An elevator ventilation fan assembly as defined in claim 1 in which the cover panel and cover panel support framework are configured to support a weight of up to 300 pounds.

16. An elevator ventilation fan assembly as defined in claim 1 in which:

the assembly comprises a removable side panel carried by the side wall in a position covering a side access opening in the side wall, and a fan motor junction box carried within the enclosure by the lid and accessible via the side access opening upon removal of the removable side panel; and the fan motor junction box comprises an elbow conduit configured to route and protect the electrical power source wiring extending into the enclosure and junction box housing through a wiring hole in the enclosure.

17. An elevator ventilation fan assembly as defined in claim 1 in which:

the assembly comprises a removable side panel carried by the side wall in a position covering a side access opening in the side wall, and a fan motor junction box carried within the enclosure by the lid and accessible via the side access opening upon removal of the removable side panel; and the removable side panel is carried by the enclosure on a side of the enclosure adjacent the fan motor junction box and comprises slots positioned to receive threaded posts extending from adjacent sides of the enclosure such that loosening of nuts threadedly engaged on the threaded posts allows the side panel to be removed.

18. An elevator ventilation fan assembly as defined in claim 1 in which the assembly includes a fan duct that surrounds the fan and that is carried by the enclosure lid around and generally co-extensive with the exhaust air hole.

19. An elevator ventilation fan assembly as defined in claim 1 in which the assembly includes handles positioned for level carry.

20. An elevator ventilation fan assembly as defined in claim 19 in which the handles are:

disposed on opposite sides of the enclosure;

laterally centered relative to the center of gravity of the assembly; and vertically disposed above the assembly center of gravity.

* * * * *